US005183603A

United States Patent [19]

Kitajima et al.

[11] Patent Number: 5,183,603

[45] Date of Patent: Feb. 2, 1993

[54] PROCESS FOR PRODUCING A COIL-SHAPED CARBON FIBER BUNDLE

[75] Inventors: Eiji Kitajima, Izumi; Takashi Oyama; Eiji Maruden, both of Izumi-Otsu; Hirokazu Teraoka, Sakai; Haruki Yamasaki, Isehara; Susumu Shimizu, Chuo, all of Japan

[73] Assignees: Koa Oil Company Limited; Tanaka Kikinzoku Kogyo Kabushiki Kaisha, both of Tokyo, Japan

[21] Appl. No.: 780,301

[22] Filed: Oct. 22, 1991

[30] Foreign Application Priority Data

Oct. 24, 1990 [JP] Japan ..... 2-286323
Feb. 7, 1991 [JP] Japan ..... 3-60886

[51] Int. Cl.[5] ..... D01F 9/12

[52] U.S. Cl. ..... 264/29.2; 264/103; 264/129; 264/171; 264/210.5; 264/210.8; 264/211.11

[58] Field of Search ..... 264/171, 211.11, 103, 264/129, 130, 29.2, 85, 210.8, 210.2, 210.6

[56] References Cited

U.S. PATENT DOCUMENTS 3,639,953 2/1972 Kimura et al. ..... 264/171 X

FOREIGN PATENT DOCUMENTS 1-33413 8/1990 Japan .
3-90626 4/1991 Japan .

*Primary Examiner*—Leo B. Tentoni
*Attorney, Agent, or Firm*—Wenderoth, Lind & Ponack

[57] ABSTRACT

The present invention relates to a carbon fiber bundle comprising a regular coil-shaped fiber bundle and having excellent stretch characteristic. A process for producing a coil-shaped carbon fiber bundle according to the present invention comprises the steps of compositing at least two kind of pitches to spin them as single fibers, bundling the thus spun single fibers to form a fiber bundle, then infusibilizing the resulting fiber bundle under tension and carbonizing the fiber bundle.

9 Claims, 1 Drawing Sheet

PROCESS FOR PRODUCING A COIL-SHAPED CARBON FIBER BUNDLE

BACKGROUND OF THE INVENTION

This invention relates to a carbon fiber and, more particularly, to a process for producing a pitch carbon fiber bundle adjusted in the form of a coil.

In general, carbon fibers are roughly divided into a PAN system and a pitch system. PAN carbon fibers are produced by firing polyacrylonitrile fiber under specific conditions. Pitch carbon fibers are produced by melt spinning an anisotropic pitch or isotropic pitch and thereafter infusibilizing and carbonizing it.

These carbon fibers are applied to products adapted for features depending upon raw materials and characteristics and widely utilized as materials for aerospace industry, sports or leisure products.

The carbon fibers which have heretofore been produced have excellent physical and chemical properties such as light-weight, high strength, heat resistance and chemical resistance. However, the carbon fibers generally exhibit a behavior as brittle materials and have low elongation and inferior softness. Accordingly, the prior art carbon fibers are not necessarily suitable as materials for which these characteristics are required. Further, in the prior art process for producing carbon fibers, it is difficult to produce fibers or fiber bundles having excellent elongation and elasticity.

In view of such prior art, we have already proposed a process for producing a curl-shaped fiber comprising an isotropic texture and an anisotropic texture and having excellent elasticity by separately feeding an isotropic pitch and an anisotropic pitch and spinning these pitches from a spinneret at the same time (Japanese Patent Laid-Open Publication No. 90626/1991).

According to this process, carbon fiber materials having excellent elasticity can be obtained with relatively low cost. However, the softening point of the isotropic pitch is different from that of the anisotropic pitch and their attenuation behaviors after discharge are different. Accordingly, it is not necessarily easy to spin the isotropic and anisotropic pitches at the same time. Further, in the case where the isotropic and anisotropic textures only coexist or coexisted these fibers are merely infusibilized and carbonized, the resulting fibers are randomly curled every single yarn and therefore bulky and wavy fibers are obtained, but fibers having good stretchability cannot be obtained. Thus the fibers are not entirely satisfactory.

SUMMARY OF THE INVENTION

An object of the present invention is to provide an effective process for obtaining a carbon fiber bundle comprising a regular fiber bundle and having excellent stretchability and elasticity.

We have studies in order to obtain a carbon fiber having excellent stretchability. We have now found that a coil-shaped fiber bundle having the same coil direction and having excellent stretchability can be obtained by compositing at least two pitches having specific nature to spin them as single fibers, bundling these single fibers, infusibilizing the thus obtained bundle under specific conditions and carbonizing it.

The process for producing the coil-shaped carbon fiber bundle according to the present invention is achieved on the basis of the finding described above. More particularly, the process for producing the coil-shaped carbon fiber bundle according to the present invention comprises the steps of: compositing at least two pitches wherein the maximum difference in coefficient of linear contraction in the direction of a fiber axis during carbonization of spun pitches is at least 5% and the difference in the softening points of the pitches to be composited is within 10° C. to spin the pitch composite as single fibers; bundling the thus spun single fibers to form a fiber bundle; then infusibilizing the resulting fiber bundle under tension; and carbonizing the fiber bundle.

Another embodiment of the present invention comprises the steps of: compositing at least two pitches wherein the maximum difference in coefficient of linear contraction in the direction of a fiber axis during carbonization of spun pitches is from 1% to 5% and the difference in the softening points of the pitches to be composited is within 10° C. to spin the pitch composite as single fibers; bundling the thus spun single fibers to form a fiber bundle; then twisting the fiber bundle and/or infusibilizing the resulting fiber bundle under tension with twisting; and carbonizing the fiber bundle.

The thus obtained carbonized fibers comprise coil-shaped fiber bundle having excellent stretchability wherein the coil direction of individual single fibers is the same and highly regulated as shown in FIG. 1.

DETAILED DESCRIPTION OF THE INVENTION

Figure 1:
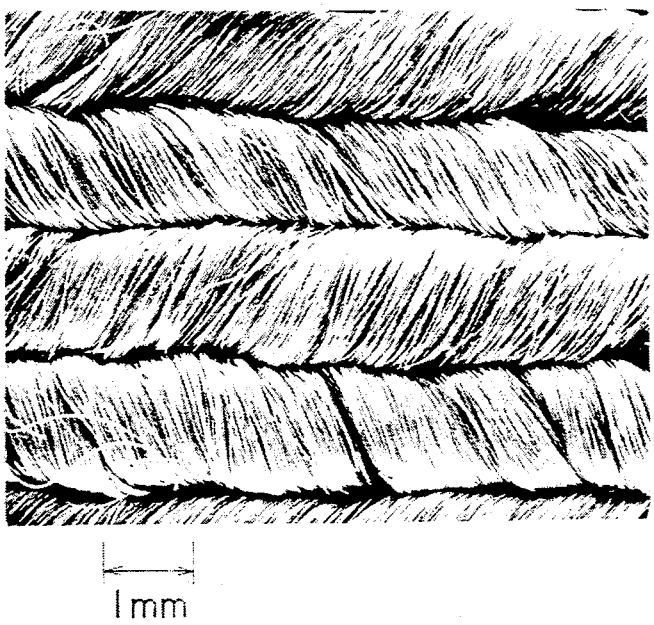
FIG. 1 is a microphotograph showing the shape of a coil-shaped carbon fiber bundle obtained by a process described in Example of the present invention.

The source and composition of pitches which are spinning raw materials in the present invention are not limited and known petroleum and coal spinning pitches can be widely used provided that the maximum difference in coefficient of linear contraction in the direction of a fiber axis during carbonization is at least 5% and the difference in the softening points of the pitches is within 10° C.

Further, in the second embodiment of the present process, pitches wherein the maximum difference in coefficient of linear contraction in the direction of a fiber axis during carbonization is from 1% to 5% can also be used. In this case, additional operation of twisting is necessary to obtain a highly regulated coil-shaped fiber bundle as in the first embodiment of the present invention.

The pitches can be selected from optically isotropic pitches, optically anisotropic pitches, isotropic component-anisotropic component-mixed pitches, or combinations thereof.

The process for compositing the spinning pitches of plural types to spin as single fibers can be a process wherein the pitches are composited by feeding at least two pitches into a spinning apparatus in unmixed state, and melt spinning the pitches at the same time by means of a composite nozzle. A spinning apparatus described in Japanese Patent Laid-Open Publication No. 90626/1991 can be used as the apparatus for spinning such composited single fibers.

The torsion or twist of the fibers in the present invention is developed by the difference in linear contraction coefficient during carbonization of pitches from which composited fibers are produced. If the difference in percent shrinkage is less than 5%, fibers will slightly waved and highly regulated coil-shaped fiber bundles cannot be obtained without twisting.

In composite spinning at least two pitches, it is preferred that the optimum spinning temperatures of respective pitches are consistent. Usually, the viscosities of the spinning pitches largely vary depending upon temperature and therefore the optimum spinning temperature range is narrow. Therefore, in order to spin well, it is preferred that viscosities of the pitches at spinning temperatures be substantially approximate. For this purpose, it is vital that the difference in the softening points of the pitches is not more than 10° C.

The proportion of cross-section of the fiber of the pitch based on total cross-section in compositing pitches of plural types influences the coiling characteristics of the obtained carbon fibers. The larger amount of the pitch having a large coefficient of linear contraction during carbonization has the larger extent of torsion. Thus, good coil-shaped fiber bundle can be obtained. While the proportion of the pitch having a large coefficient of linear contraction is not limited in the present invention, it is preferably within the range of about 5% to about 95%, more preferably from 20 to 90%, and most preferably from 30 to 80%. If the amount of the pitch having a large linear contraction coefficient during carbonization is less than about 5%, the extent of coilability will be reduced and its stretchability tends to be reduced. If the amount of the pitch having a large linear contraction coefficient during carbonization is more than 95%, poor coil-shaped product will be obtained.

When the composite pitch fibers are stranded, the direction of the coil formation becomes uneven if the position of each pitch in the fibers is not the same. In such a case, it is preferred that the spun pitches be treated with a bundling agent to fix the direction to lateral direction of fibers. The bundling agents used for such a purpose include ethyl alcohol, a mixture of ethyl alcohol with water, and a mixture of ethyl alcohol with a silicone oil-aqueous emulsion.

It is preferred that the filament number of the fiber bundle be not more than 10,000.

The pitch fibers tend to slightly shrink in the infusibilization step and therefore the bundled fiber is disturbed. When the thus disturbed bundle is carbonized, the direction of torsion is disturbed and a good coil-shaped product cannot be obtained. We have now found that a coil-shaped fiber bundle having the same coil direction and having excellent stretchability can be obtained by infusibilizing the bundle of the fibers obtained under conditions as described above under tension and carbonizing it. While the infusibilization step can be suitably adjusted depending upon types of the spinning pitches used and combinations thereof, the infusibilization is preferably carried out under a tension of at least 0.0001 gram per each filament, and more preferably at least about 0.0004 grams per each filament.

While the carbonization step is desirably carried out substantially under a non-tension, the tension force of no more than 0.05 grams per each filament may be present. If the tension of more than 0.05 grams per each filament is applied during carbonization, the difference in the percent linear shrinkage of composited pitches will be reduced and a good coil-shaped product cannot be obtained.

While the temperature used in infusibilization of carbon fiber bundle is not limited, infusibilization can be usually carried out at a temperature within the range of 220° to 300° C. Carbonization can be carried out at a temperature within the range of 700° to 3,000° C.

In the second embodiment of the present invention, by giving twist to the bundled fiber before infusibilization and/or during infusibilization, a good coil-shaped fiber bundle having good stretch characteristics can be obtained. In this case, the number of twist is preferably at least 10 turn/m.

The thus produced pitch carbon fiber bundle has such a coiled morphology that single fibers are arranged neatly side by side in the form of a coil as shown in FIG. 1. When load is applied, the fiber bundle exhibits an elongation of 10% to 100% or more. When load is released, the fiber bundle is instantly restored to original length. Thus, the fiber bundle exhibits a behavior similar to an elastic rubber cord. Further, this stretch characteristics is maintained after stretching is repeated 10,000 times as shown in the following Examples.

Furthermore, the coil-shaped carbon fiber bundle having desired stretch characteristics can be produced by adjusting the composite proportion of the spinning pitches, the size of the diameter of fibers, the number of fiber bundle and the like as shown in the following Examples.

Petroleum heavy oils were used as raw materials to prepare spinning pitches A to F having different linear contraction coefficient during carbonization as shown in Table 1.

EXAMPLE 1

A spinning pitch B and a spinning pitch A shown in Table 1 were separately fed to the inside (pitch B) and outside (pitch A) of a sheath-core type composite nozzle having a diameter of an inside nozzle of 0.2 mm and a diameter of an outside nozzle of 0.5 mm, respectively, and spun at the same time from a discharge hole to obtain a composite pitch fiber comprising pitches A and B. During this time, the discharge pressure of each pitch was adjusted so that the discharge ratio of A:B is 20:80. Spinnability was good and yarn cutting did not occur over one hour. 1,500 composite pitch fibers were bundled using ethyl alcohol, infusibilized under tension of 0.0004 grams per each fiber in air at 290° C, thereafter tension was released and carbonization was carried out in a nitrogen atmosphere at 1,000° C. The thus obtained pitch carbon fiber bundle has such a coiled morphology that single fibers are arranged in the form of coil as shown in the microphotograph of FIG. 1. When load was applied, the fiber bundle exhibited an elongation of at least 100%. When load was released, the fiber bundle was instantly restored to original length. Thus, the fiber bundle exhibited a behavior similar to an elastic rubber cord. Further, this stretchability was maintained after stretching was repeated 10,000 times.

EXAMPLE 2

The fiber bundle spun and infusibilized as in Example 1 was carbonized under a tension of 0.01 gram per each fiber to obtain a coil-shaped fiber bundle. The thus obtained fiber bundle exhibited coil-shaped torsion as in Example 1 and the elongation obtained by applying load was 65%.

COMPARATIVE EXAMPLE 1

The composite pitch fiber bundle spun as in Example 1 was infusibilized under a non-tension and thereafter carbonized. The fiber bundle was disturbed in the infusibilization step and therefore the coil-shaped portion and the coil-free portion were present and its stretchability was inferior.

COMPARATIVE EXAMPLE 2

The fiber bundle spun and infusibilized as in Example 1 was carbonized under a tension of 0.1 gram per each fiber to obtain a coil-shaped fiber bundle. The thus obtained fiber bundle was not in the form of a coil and its stretchability was not observed at all as with conventional carbon fibers.

COMPARATIVE EXAMPLE 3

A spinning pitch D and a spinning pitch A at a ratio of 80:20 were composited and spun as in Example 1, and infusibilization and carbonization were carried out. In this case, the difference in their linear contraction coefficient during carbonization was small and therefore a coil-shaped fiber bundle was not obtained.

COMPARATIVE EXAMPLE 4

A spinning pitch B and a spinning pitch C at a ratio of 80:20 were composited and spun as in Example 1. The difference in the softening points of both pitches was large and therefore the respective spinnable temperature range was different, yarn cutting frequently occurred at any spinning temperature and composite fibers were not obtained.

EXAMPLE 3

A spinning pitch B and a spinning pitch A shown in Table 1 were separately fed to the inside and outside of a sheath-core composite nozzle as in Example 1, respectively, and spun at the same time from a discharge hole to obtain a composite pitch fibers composed of the spun pitches A and B. During this time, the discharge pressure of each pitch was adjusted, thereby various composite pitch fibers having different discharge proportion were obtained. In this case, spinnability was good at any discharge proportion and yarn cutting did not occur over one hour.

The thus obtained 1,500 composite pitch fibers were bundled using ethyl alcohol, infusibilization and carbonization were carried out as in Example 1. As shown in Table 2, in the cases of the thus obtained various coil-shaped carbon fiber bundles having different discharge ratios, it was observed that the stretch characteristic of the fiber bundle was optionally controlled by adjusting the discharge ratio of the spinning pitch B as shown in Table 2 below.

EXAMPLE 4

A coil-shaped carbon fiber bundle was obtained as in Example 3 except that a spinning pitch A and a spinning pitch B shown in Table 1 were separately fed to the inside and outside of a sheath-core composite nozzle as in Example 1, respectively. As shown in Table 2, in the cases of the thus obtained various coil-shaped carbon fiber bundle having different discharge ratios, it was observed that the stretch characteristic of the fiber bundle was optionally controlled by adjusting the discharge ratio of the spinning pitch B.

EXAMPLE 5

A coil-shaped carbon fiber bundle was obtained as in Example 1 except that a spinning pitch A and a spinning pitch B were fed to the inside and outside of the nozzle, respectively, and the fiber diameter of composite pitch fibers or the number of bundled fibers were varied.

As shown in Table 3 below, it was observed that the stretch characteristic of the obtained various coil-shaped carbon fiber bundles was optionally controlled by adjusting the fiber diameter of single fibers or the bundle number of the fibers.

EXAMPLE 6

A spinning pitch F and a spinning pitch E shown in Table 1 were separately fed to the inside (pitch F) and outside (pitch E) of a sheath-core type composite nozzle having a diameter of an inside nozzle of 0.2 mm and a diameter of an outside nozzle of 0.5 mm, respectively, and spun at the same time from a discharge hole to obtain a composite pitch fiber comprising pitches E and F. During this time, the discharge pressure of each pitch was adjusted so that the discharge ratio of E:F is 20:80. Spinnability was good and yarn cutting did not occur over one hour. 1,500 composite pitch fibers were bundled using ethyl alcohol, then the obtained bundle was twisted by 10 turn/m, and in this twisted state, the bundle was infusibilized under tension of 0.0004 grams per each fiber in air at 290° C., thereafter tension was released and carbonization was carried out in a nitrogen atmosphere at 1,000° C. The thus obtained pitch carbon fiber bundle has such a coiled morphology that single fibers are arranged in the form of highly regulated coil bundle. When load was applied, the fiber bundle exhibited an elongation of at least 100%. When load was released, the fiber bundle was instantly restored to original length. Thus, the fiber bundle exhibited a behavior similar to an elastic rubber cord. Further, this stretchability was maintained after stretching was repeated 10,000 times.

EXAMPLE 7

The fiber bundle was obtained in the same manner of EXAMPLE 6 except that the pitch A and pitch D were used. The obtained fiber bundle exhibited good coil shape and good stretchability as in EXAMPLE 6.

COMPARATIVE EXAMPLE 5

The fiber bundle was obtained in the same manner of EXAMPLE 6 except that twisting was not carried out. The obtained fiber bundle had slightly waved shape and did not become a coil-shaped bundle as in EXAMPLE 6.

TABLE 1

(Physical Properties of Spinning Pitch)

| Pitch Name | Softening Point (°C.) | Proportion of Anisotropic Texture (%) | Toluene Insoluble Matter (%) | Quinoline Insoluble Matter (%) | Coefficient of Linear Contraction during Carbonization (%) |
|---|---|---|---|---|---|
| A | 235 | 99 | 77 | 30 | 5.8 |
| B | 235 | 0 | 56 | 0 | 12.9 |
| C | 260 | 100 | 80 | 33 | 5.8 |
| D | 240 | 52 | 70 | 8 | 8.5 |
| E | 220 | 0 | 59 | 0 | 9.8 |
| F | 220 | 99 | 70 | 23 | 7.9 |

TABLE 2

| Content of Spinning pitch B in Fiber (%) | Elongation at a Load of 100 g (%) | | Elongation at a Load of 1000 g (%) | |
|---|---|---|---|---|
| | Ex. 3 | Ex. 4 | Ex. 3 | Ex. 4 |
| 20 | 30 | 40 | — | — |
| 30 | — | — | ≧100 | ≧100 |
| 50 | 45 | 47 | ≧100 | ≧100 |
| 90 | 65 | 58 | ≧100 | ≧100 |

TABLE 3

| Number of bundled fiber | Fiber Diameter (μm) | Elongation (%) | | |
|---|---|---|---|---|
| | | Load of 20 g | Load of 50 g | Load of 80 g |
| 1,000 | 15 | 23 | 38 | 44 |
| 1,000 | 25 | 20 | 33 | 41 |
| 3,000 | 15 | 9 | 18 | 24 |

What is claimed is:

1. A process for producing a coil-shaped carbon fiber bundle comprising the steps of:

compositing at least two pitches wherein the maximum difference in coefficient of linear contraction in the direction of a fiber axis during carbonization of spun pitches is at least 5% and the difference in the softening points of the pitches to be composited is within 10° C. so as to spin the thus composited pitches as single fibers; bundling the thus spun single fibers to form a fiber bundle; then infusibilizing the resulting fiber bundle under tension; and carbonizing the fiber bundle, wherein the stretch characteristics of the resulting coil-shaped carbon fiber bundle is controlled by adjusting one or more of the discharge proportion of the spinning pitches to be composited, the size of the diameter of fibers to be spun or the number of fibers to be bundled.

2. The process according to claim 1, wherein the pitches are composited by optically isotropic pitches, optically anisotropic pitches, isotropic component-anisotropic component-mixed pitches, or combinations thereof.

3. The process according to claim 1, wherein the pitches are composited by feeding at least two pitches to a spinning apparatus in unmixed state, and melt spinning the pitches at the same time by means of a composite nozzle.

4. The process according to claim 3, wherein the discharge proportion of a pitch having a largest linear contraction coefficient is within the range of from about 5% to about 95% of the total amount in spinning so that the single fibers are formed by means of a composite nozzle.

5. The process according to claim 1, wherein the single fibers are bundled to such a fiber bundle that the filament number of the spun single fibers is not more than 10,000.

6. The process according to claim 1, wherein a bundling agent selected from the group consisting of ethyl alcohol, a mixture of ethyl alcohol with water, and a mixture of ethyl alcohol with a silicone oil-aqueous emulsion is used in bundling the fibers.

7. The process according to claim 1, wherein the tension used in infusibilization is at least 0.0001 gram per fiber.

8. The process according to claim 1, wherein the carbonization step is carried out under substantially no tension.

9. The process according to claim 1, wherein the carbonization step is carried out under such conditions that the tension during carbonization is not more than 0.05 grams per fiber.

* * * * *